US006105825A

United States Patent [19]

Gomi et al.

[11] Patent Number: 6,105,825

[45] Date of Patent: Aug. 22, 2000

[54] ICE-COOLED SERVER

[75] Inventors: Tatsuya Gomi; Kazuo Furuichi, both of Yokohama, Japan

[73] Assignee: Suntory Limited, Osaka, Japan

[21] Appl. No.: 08/842,819

[22] Filed: Apr. 17, 1997

[30] Foreign Application Priority Data

Feb. 7, 1997 [JP] Japan ..... 9-024570

[51] Int. Cl.[7] ..... B67D 5/62

[52] U.S. Cl. ..... 222/146.6; 222/399; 222/400.7; 222/466; 62/399

[58] Field of Search ..... 222/146.6, 325, 222/400.7, 399, 466; 62/389, 399

[56] References Cited

U.S. PATENT DOCUMENTS

| | | | |
|---|---|---|---|
| 2,028,098 | 1/1936 | Zafuto | 62/399 |
| 2,092,320 | 9/1937 | Lueck | 62/399 |
| 2,506,840 | 5/1950 | Pique | 62/399 |
| 3,865,276 | 2/1975 | Thompson | 222/146.6 |
| 4,350,267 | 9/1982 | Nelson et al. | 222/399 |
| 5,119,972 | 6/1992 | Reed et al. | 222/466 |
| 5,129,552 | 7/1992 | Painchaud et al. | 222/146.6 |

FOREIGN PATENT DOCUMENTS

| | | | |
|---|---|---|---|
| 3831227 | 3/1990 | Germany | 222/146.6 |
| 7330090 | of 0000 | Japan . | |

*Primary Examiner*—Philippe Derakshani
*Attorney, Agent, or Firm*—Bachman & LaPointe, P.C.

[57] ABSTRACT

An ice-cooled server installed on a drink container has an outer shell body having a truncated-cone shaped step bottom portion. A spiraled cooling pipe is fixedly set in a refrigerant receiver which is fixedly set inside of the outer shell body. A dispense cock is disposed at an outer periphery of said outer shell body and connected to an end of the cooling pipe. The other end of the cooling pipe is connected to a dispense head fixed at a lower and center portion of the outer shell body through a supporting plate. This construction facilitates the installation and detachment of the ice-cooled server to and from the drink container and improves a cooling ability of the server.

10 Claims, 8 Drawing Sheets

ICE-COOLED SERVER

BACKGROUND OF THE INVENTION

1. Field of the Invention

The present invention relates to improvements in an ice-cooled server installed on a drink container such as on a beer keg, which server enables beer to be directly poured into a mug or jug from a beer keg by feeding carbon dioxide gas from a small-sized gas cylinder, and more particularly to an ice-cooled server which preferably cools drink from a drink container and is conveniently used by common people.

2. Description of Related Art

Recently small-sized beer kegs are widely used on the market and are used at restaurants or bars. Since preferable cooling makes draft-beer most delicious, in order to drink cooled draft-beer, draft beer filled in a keg or bottle is previously cooled in a refrigerator or the like, and the cooled beer is then poured in a mug or jug. Such small-sized beer kegs require to be put in a big refrigeration for cooling them.

Japanese Patent Provisional Publication No. 7-330090 discloses a dispenser for easily and rapidly cooling draft-beer from a beer keg without using a refrigerator. This dispenser is directly installed to a keg neck interface of a drink container such as a beer keg and is used to serve draft-beer into a mug or jug from the beer keg by feeding pressurized carbon dioxide gas from a small-sized carbon dioxide gas cylinder into the beer keg. The conventional dispenser is provided with a cooling pipe for connecting a dispense head attached to the keg neck interface of the beer keg and a dispense cock through which beer is directly poured to a mug or jug. The cooling pipe is spiraled and is disposed in a refrigerant receiver to which refrigerant is set to cool the beer flowing through the cooling pipe.

However, this conventional dispenser with the beer cooling mechanism is further required to improve in handling and installation thereof. For example, although this conventional dispenser is arranged such that the cooling pipe set in a receiver is formed into a spiral so as to ensure a length of the cooling pipe, the conventional dispenser is required to further preferably cool drink such as draft-beer by increasing the cooling capacity. Further, since this conventional dispenser is proposed to conveniently provide draft-beer from a keg at a place where professionals treat the server, the conventional server is required such that common people can easily and conveniently set and handle this server in personal use. That is, since a dispense head of this conventional server is connected only to the cooling pipe in the receiver through a flexible pipe such as a PVC (polyvinyl chloride) pipe, the dispense head dangles from the server and thereby invites a difficult centering thereof to the keg neck interface when connected to the keg. Further, since the dispense head tends to be inclined with respect to the keg neck interface, the dispense head may be incorrectly set to the keg neck interface. In addition, in case that the dispense head set at a enter portion is attached to the keg neck interface of the beer keg by rotating a set bar of the dispense head, if only the dispense head is rotated, the flexible pipe may be twisted and closed or be broken. Therefore, in the installing operation of this conventional server to the keg, it is necessary to simultaneously rotate the set bar through one hand and the server through the other hand. This largely increases the difficulty of the installing and detaching operations of the dispense head to and from the beer keg.

SUMMARY OF THE INVENTION

It is an object of the present invention to provide an improved ice-cooled server which is superior in the installation and detachment thereof to and from a drink container so that common people easily utilize it at home while improving its drink cooling ability by elongating a cooling pipe set in a receiver.

An ice-cooled server according to the present invention is installed on a drink container. The ice-cooled server comprises an outer shell body which includes a truncated-cone shaped step bottom portion put on the drink container. A refrigerant receiver is fixedly set at an inside and upper portion of the outer shell body. A cooling pipe of a spiral is fixedly disposed in the refrigerant receiver. A dispense cock is disposed at an outer periphery of the outer shell body and connected to an end of the cooling pipe through a flexible pipe. The dispense head is fixed at a generally lower center portion inside of the outer shell body and is connected to the other end of the cooling pipe through a connecting pipe. A pair of handles are fixed on the outer shell body so as to locate oppositely with respect to the center axis of the outer shell body.

With this arrangement, putting the ice-cooled server on a drink container by lifting the ice-cooled server through the handles, interlocking the dispense head with a keg neck interface of a drink container such as a keg by rotating the handles a predetermined angle, feeding carbon dioxide gas into the drink container by rotating a lever, putting ice into the refrigerant receiver, opening the dispense cock, preferably cooled drink such as draft-beer is poured into a mug or jug.

DETAILED DESCRIPTION OF THE INVENTION

Referring to FIGS. 1A to 8, there is shown a first embodiment of an ice-cooled server 1 installed on a beer keg in accordance with the present invention.

Figure 1A:
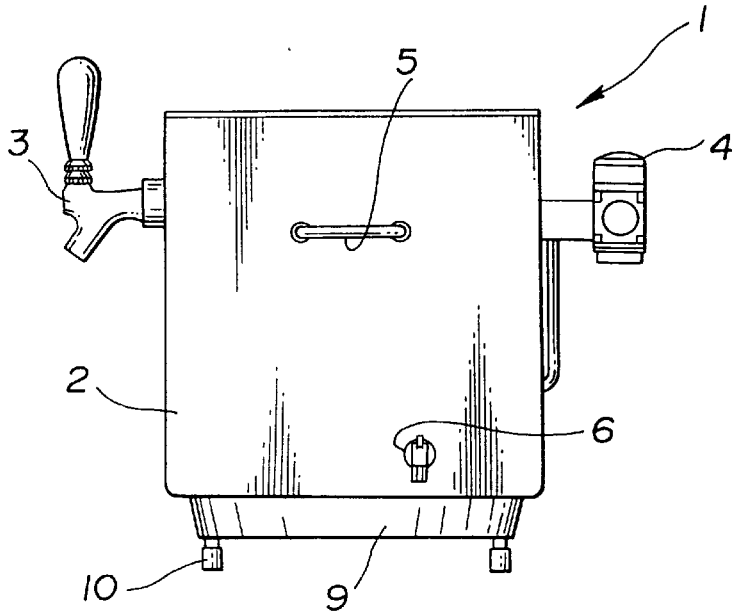
FIGS. 1A, 1B and 1C are a front view, a back view and a bottom view of a first embodiment of an ice-cooled server according to the present invention.
Figure 1C:
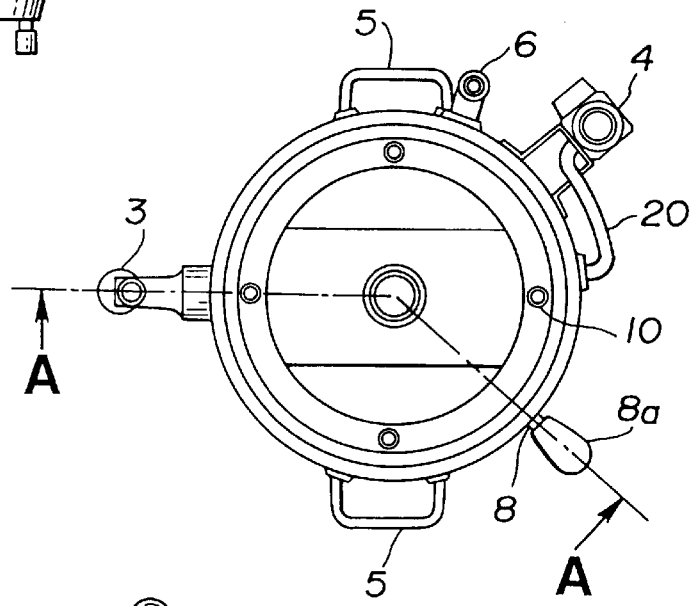
Figure 1B:
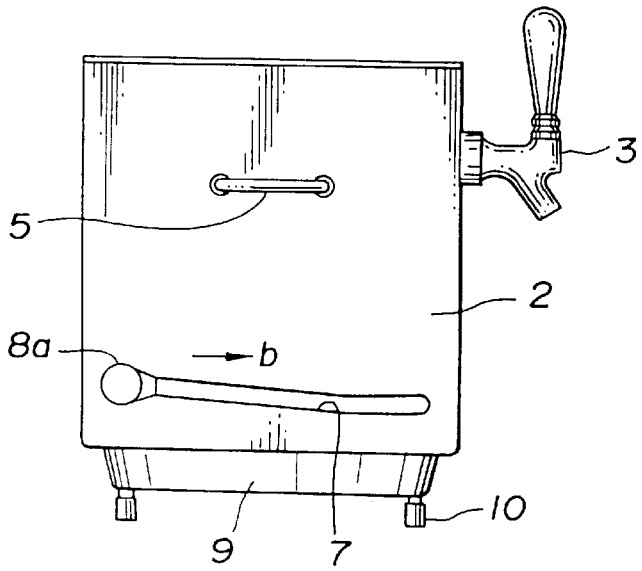

As shown in FIGS. 1A to 1C, the ice-cooled server 1 comprises an outer shell body 2 formed into a cylinder. Installed on an upper portion of the outer shell body 2 are a dispense cock 3, a pressure reducing valve 4, and a pair of handles 5 and 5. The handles 5 and 5 are oppositely disposed with respect to a center axis of the outer shell body 2.

Disposed on a lower portion of the outer shell body 2 are a drain cock 6, a guide slot 7 and a lever 8 moved in the guide slot 7. A step bottom portion 9 of a truncated-cone shape is connected to a bottom portion of the outer shell body 2. Four leg portions 10 are connected to the step bottom portion 9.

Figure 2:
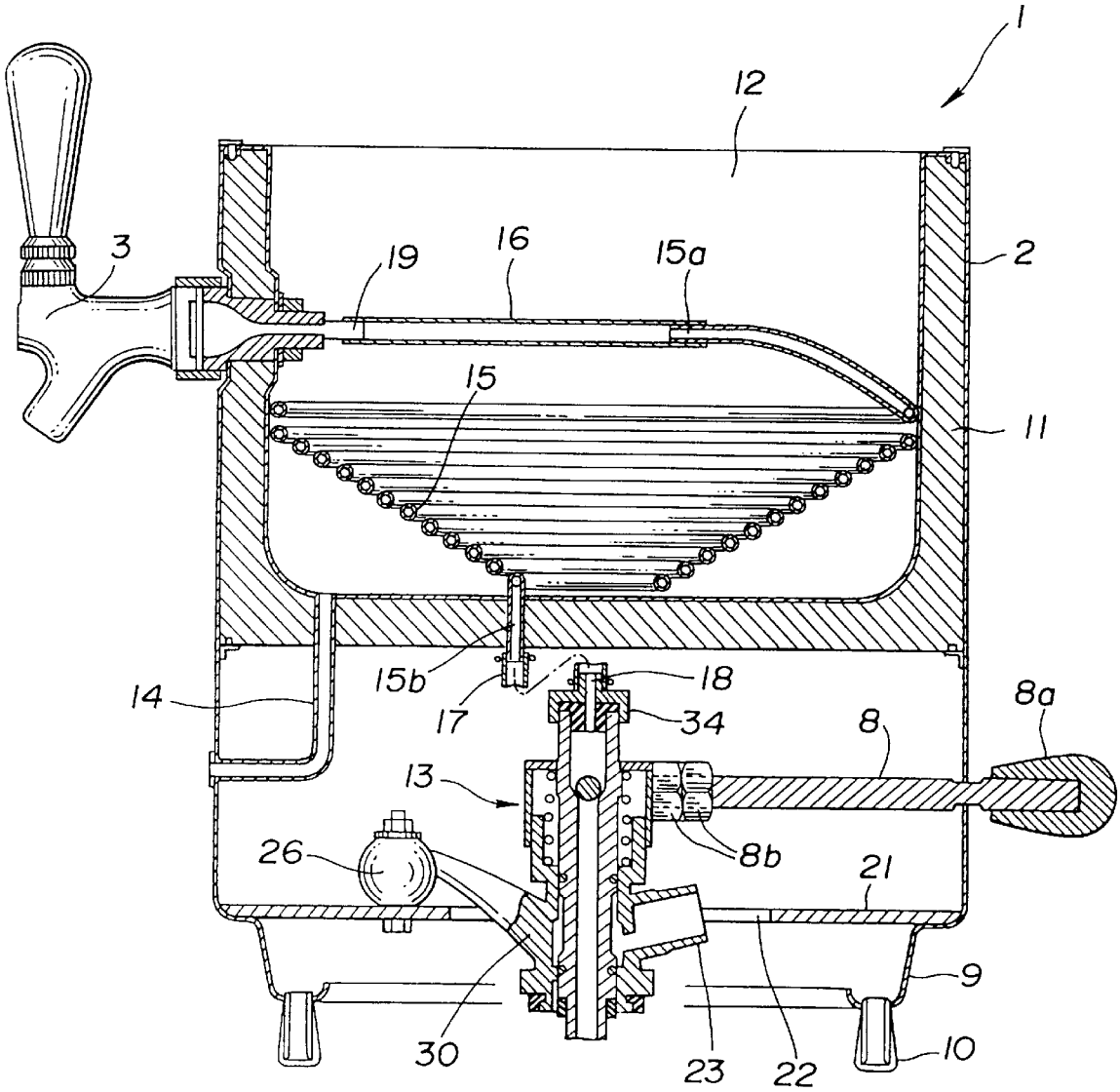
FIG. 2 is a cross-sectional view taken in line A—A in FIG. 1C.

As shown in FIG. 2, a heat insulator 11 of a cup shape is fittingly installed inside of the outer shell body 2. A refrigerant receiver 12 of a cup shape is fittingly installed to the heat insulator 11. In the outer shell body 2 and under the heat insulator 11, a dispense head 13 is disposed such that the dispense head 13 is located at a generally center portion of the outer shell body 2. An end of an L-shaped drainpipe 14 is fixedly connected to a bottom portion of the refrigerant receiver 12. The other end of the drainpipe 14 is connected to the drain cock 6 while the drainpipe 14 penetrates a bottom portion of the heat insulator 11. Each of the leg portions 10 is made by a pipe covered with covering material such as PVC (polyvinyl chloride), and has a length by which the dispense head 13 does not be contacted with a ground.

Figure 3:
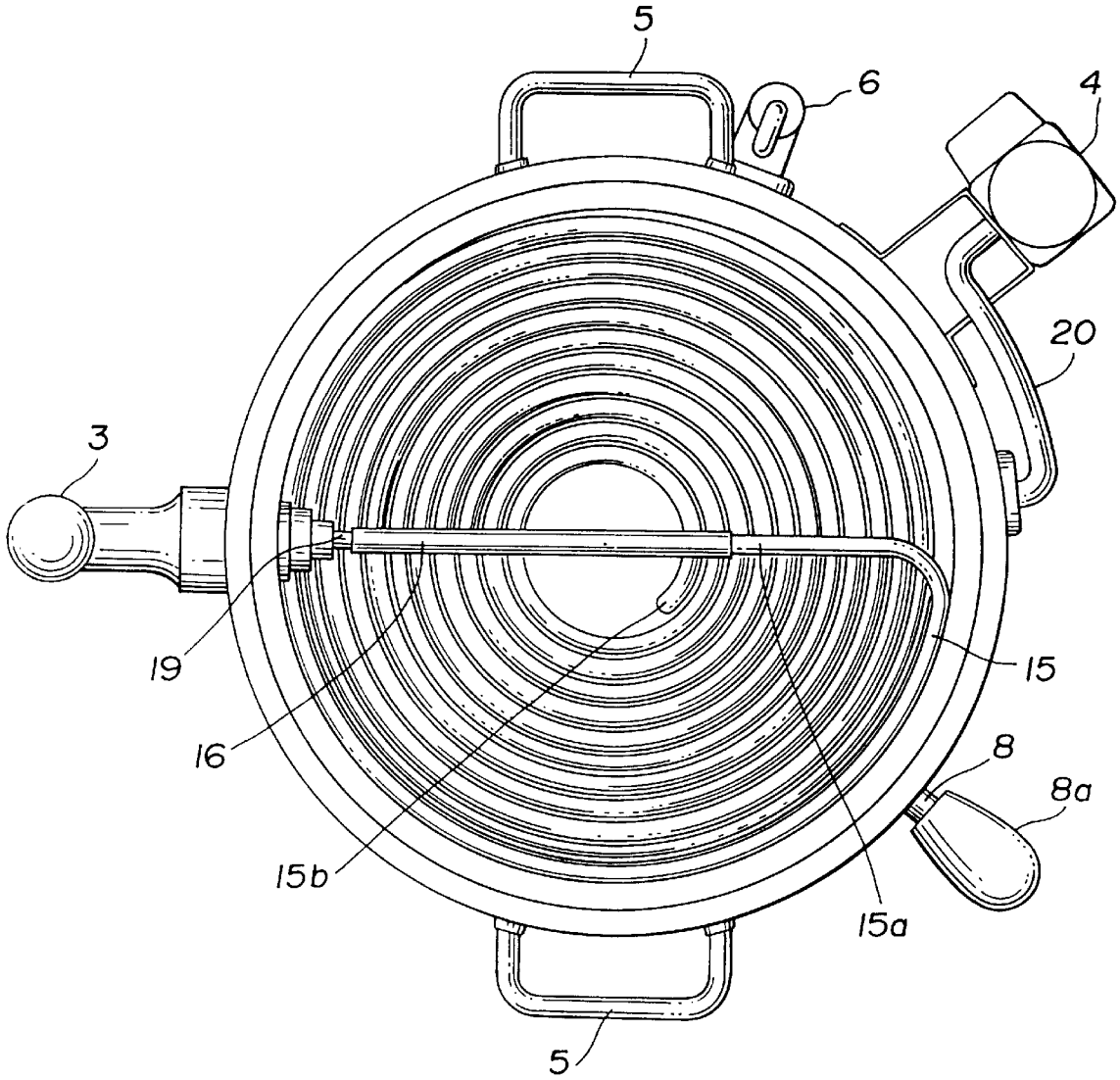
FIG. 3 is a detailed top view of FIG. 1A.

A cooling pipe 15 made of stain-less steel or aluminum alloy is formed into a spiral which has a cone-shaped appearance as shown in FIGS. 2 and 3 and is fixedly disposed in the refrigerant receiver 12. An upper end portion 15*a* of the cooling pipe 15 is horizontally extended toward the dispense cock 3 so as to cross with a center axis of the ice-cooled server 1. The upper end portion 15*a* is connected to a connecting portion 19 of the dispense cock 3 through a connecting pipe 16 made of flexible material such as PVC pipe. A lower end portion 15*b* of the cooling pipe 15 is extended toward the dispense head 13 upon penetrating the bottom portion of the refrigerant receiver 12 and the heat insulator 11. The lower end portion 15*b* is fixedly connected to a connecting portion 18 of the dispense head 13 through a flexible pipe 17 made of flexible material such as PVC pipe. The pressure reducing valve 4 is arranged to install a small-sized carbon dioxide gas cylinder as is well-known, and is connected to a gas connecting port 23 of the dispense head 13 through a pipe 20 made of flexible material such as PVC pipe. The pipe 20 is led inside of the outer shell body 2 from the pressure reducing valve 4.

Figure 4:
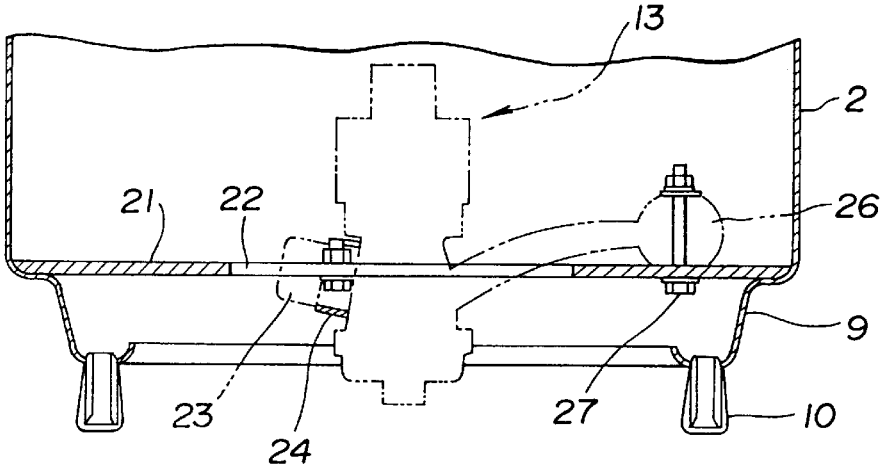
FIG. 4 is a cross-sectional view showing a bottom portion of the ice-cooled server of FIG. 1A.
Figure 5:
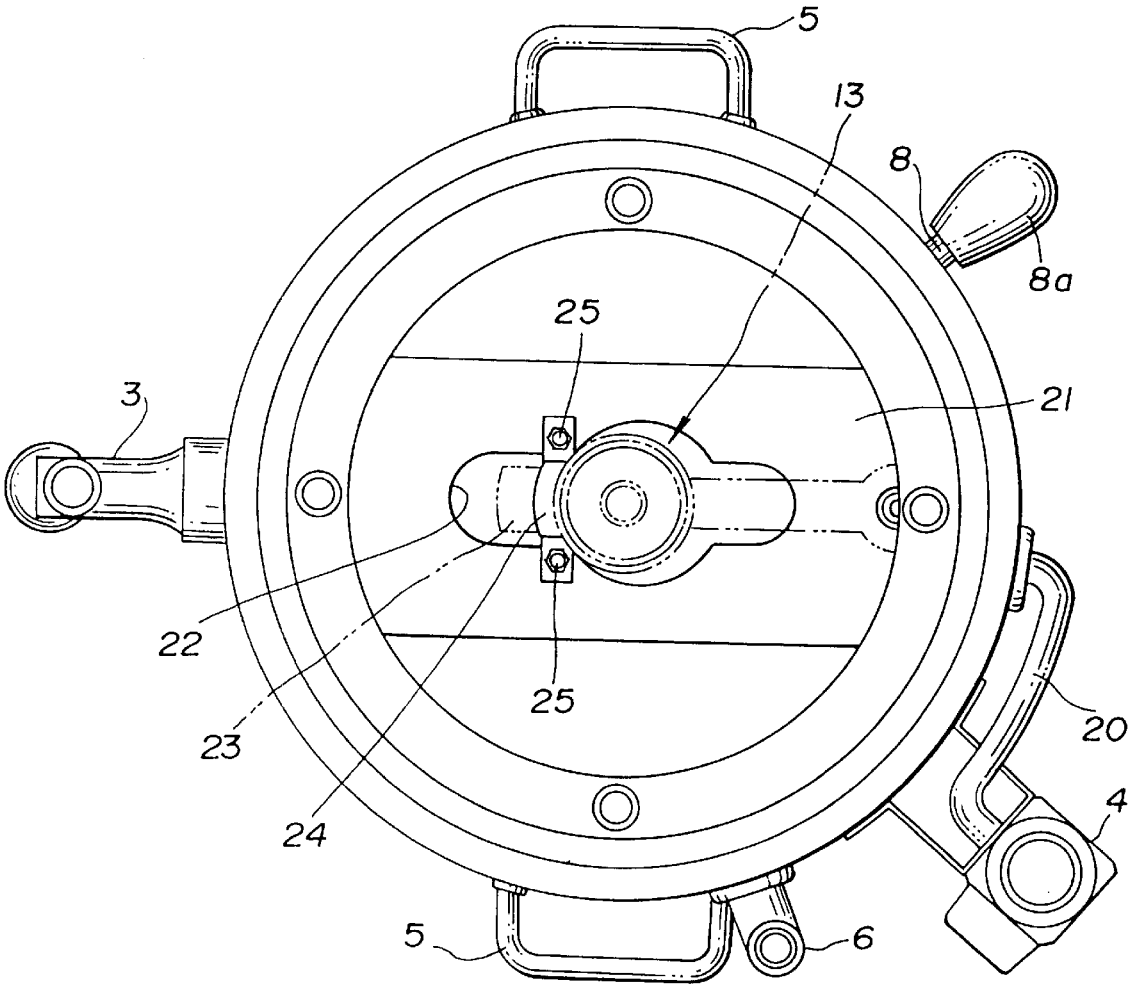
FIG. 5 is an enlarged bottom plan view of the first embodiment of the ice-cooled server where the positions of a lever and a pressure reducing valve are changed from the positions shown in FIG. 1C.

As shown in FIGS. 4 and 5, a supporting plate 21 made of an elastic member such as a plate spring is fixedly connected to a step bottom portion 9 inside of the outer shell body 2 by means of welding. A deformed slot 22 formed by the combination of a slot and a circular hole is disposed at a generally center portion of the supporting plate 21. A lower portion of the dispense head 13 is embedded in the deformed slot 22, and a bracket 24 engaged with the gas connecting port 23 is fixed to the supporting plate 21 by means of bolts 25. Further, a set bar 26 of the dispense head 13 is fixed to the supporting plate 21 by means of a bolt and nut 27.

Figure 6:
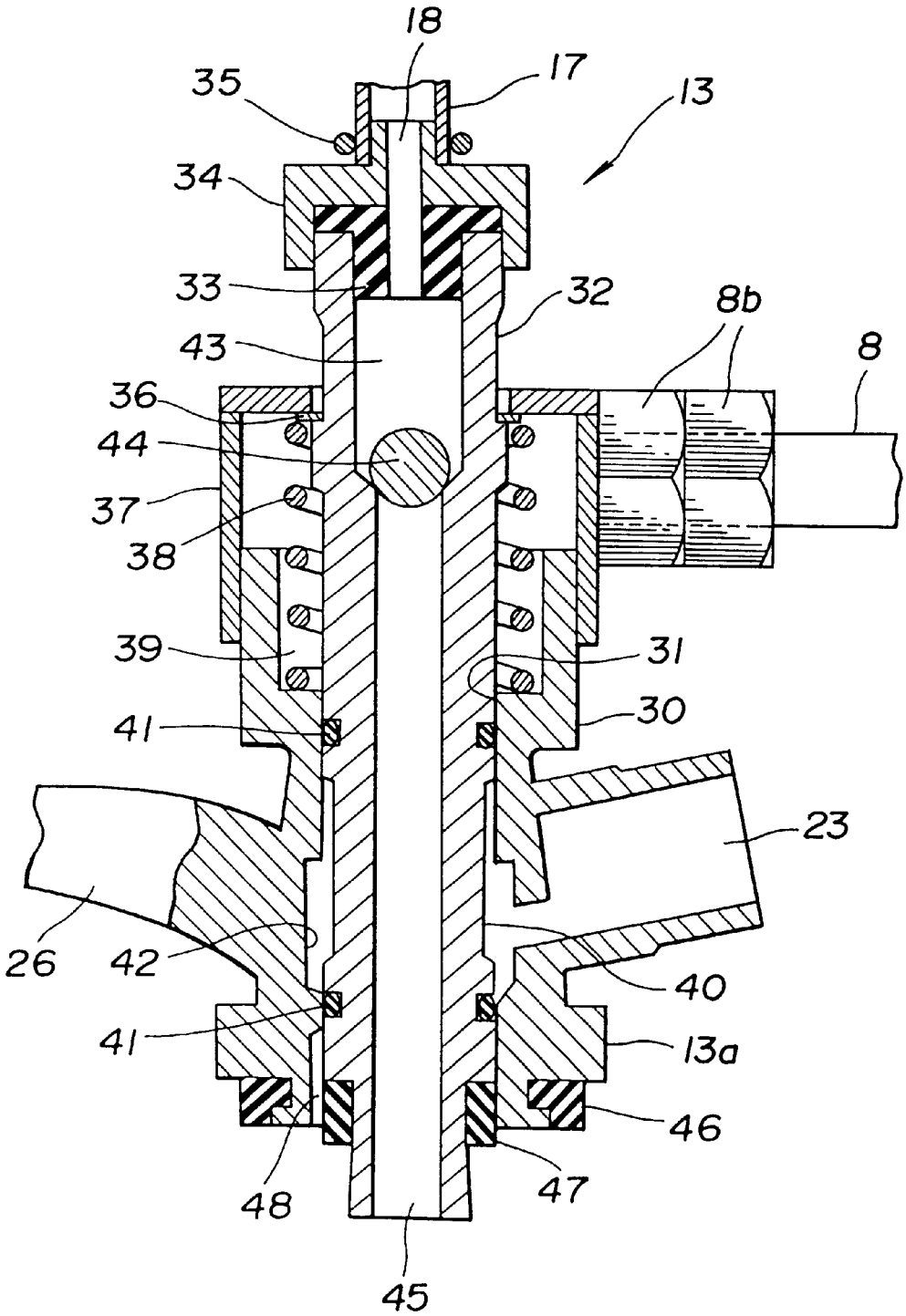
FIG. 6 is a cross-sectional view of a dispense head to be installed in the first embodiment of the ice-cooled server according to the present invention.

The dispense head 13 is of a conventional type as shown in FIG. 6. The gas connecting port 23 is integrally formed with a valve housing 30 having an axial hole 31. A hollow shaft 32 is axially and movably inserted in the axial hole 31. A coupler 34 integral with the connecting portion 18 is engaged with an upper end portion of the hollow shaft 32 while installing a packing 33 therebetween. A tightening band or ring 35 is installed to each of the pipe 20 connected with the gas connecting port 23 and a flexible pipe 17 connecting to the connecting portion 18 in order to fixedly connect therebetween. A lower end portion of the hollow shaft 32 is in contact with a beer valve 53 of a spear tube 52 engaged with the keg neck interface 51 of a drink container 50 such as a beer keg shown in FIG. 7 when the ice-cooled server 1 is set on the drink container 50.

A washer 36 is engaged with a depressed portion of the hollow shaft 32 at the upper portion of the hollow shaft 32. A cap 37 is engaged with the hollow shaft 32 at an upper side of the washer 36. An end portion of the lever 8 is interconnected with an outer periphery of the cap 37 by means of a double-nut 8*b*. The other end portion of the lever 8 is horizontally extended from the cap 37 and is projected through the guide slot 7 to an outside of the outer shell body 2 so as to be connected with a knob 8*a*. The guide slot 7 is inclinedly formed to have a predetermined inclination angle and to locate its terminal end at a position lower in height level than its initial end as shown in FIG. 1B. A compression spring 38 such as a coil spring is installed in an opening portion 39 of the valve housing 30. An upper end of the compression spring 38 is in contact with a lower side of the washer 36. Therefore, when the cap 37 is moved downward by rotating the lever 8, the hollow shaft 32 is moved down against the force of the compression spring 38 so as to push down the beer valve 53 of the spear tube 52.

A small diameter portion 40 having a predetermined length is formed at a lower and outer periphery of the hollow shaft 32. On the outer periphery of the hollow shaft 32, two grooves are formed so as to locate in the vicinity of the upper end of the small diameter portion 40 and in the vicinity of the lower end of the small diameter portion 40. Two seal rings 41 and 41 such as O-ring are installed in the respective grooves formed in the vicinity of the both ends of the small diameter portion 40. The seal rings 41 and 41 are slidably and sealingly in contact with an inner periphery of the axial hole 31 of the valve housing 30. The seal rings 41 and 41 are disposed at portions located so as to sandwich a valve chamber 42 communicated with the gas connecting port 23. An axial hole 45 of the hollow shaft 32 includes an enlarged hole portion 43 at its upper portion. A check valve 44 of a ball shape is installed in the enlarged hole portion 43. A seal packing 46 is installed at a lower end of the valve housing 30, and a seal packing 47 is installed to a lower end of the hollow shaft 32. A plurality of slits 48 are formed along the axial direction at a lower end portion of an inner periphery defining the axial hole 31 of the valve housing 30 at predetermined intervals.

Figure 7:
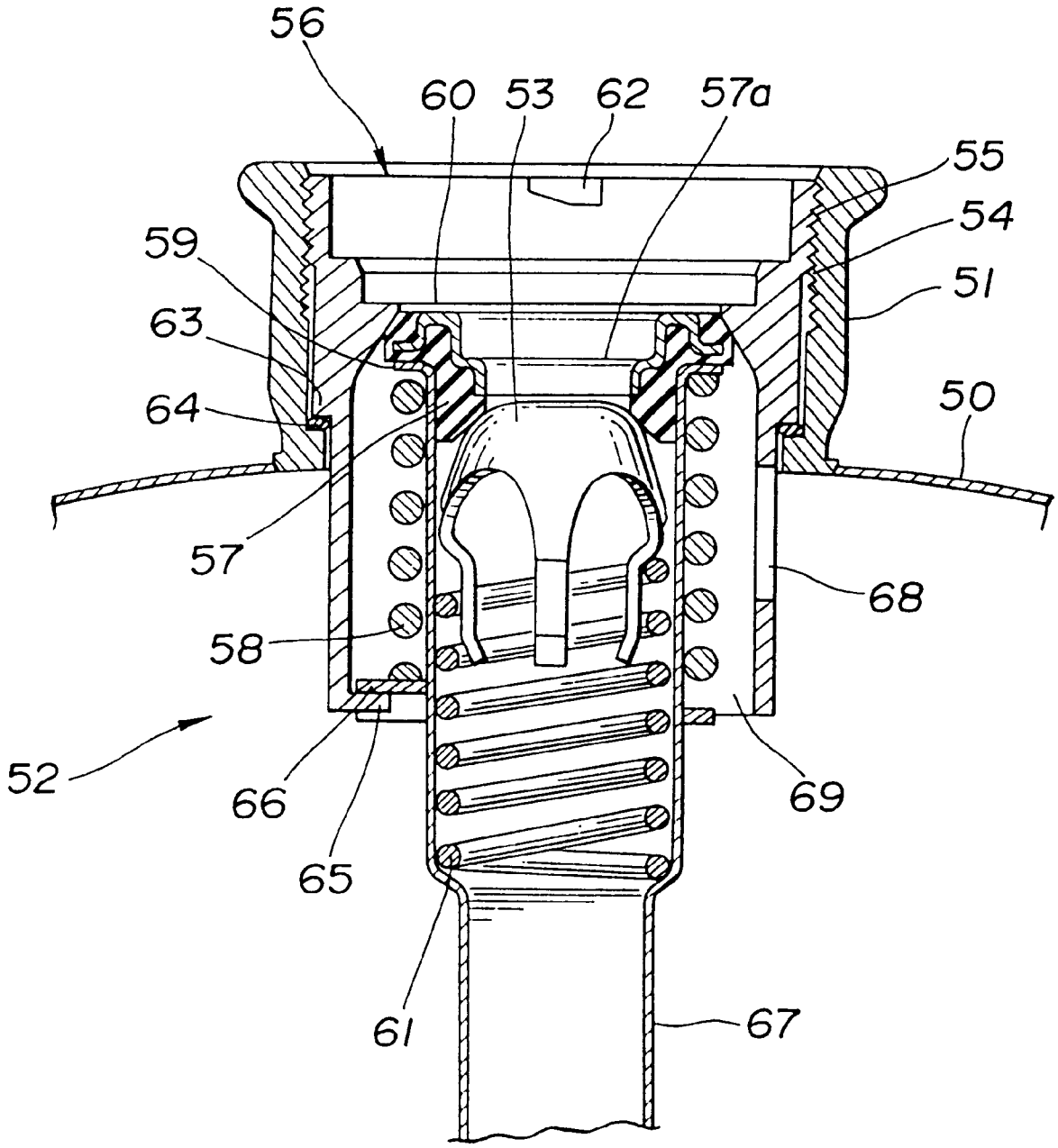
FIG. 7 is a cross-sectional view of a keg neck portion of a drink container to which the ice-cooled server is attached.

FIG. 7 shows a structure of the drink container 50 including the keg neck interface 51 and the spear tube 52. A body 56 of the spear tube 52 is engaged with the keg neck interface 51 by screwing an outer thread portion 55 of the body 56 to an inner thread portion 54 of the keg neck interface 51. An inner step portion 60 is formed inside of the body 56. The seal packing 46 of the dispense head 13 is in contact with an upper surface of the inner step portion 60, and the seal packing 47 of the dispense head 13 is in contact with a gas valve 57 of the spear tube 52 which valve is in contact with the inner step portion 60, when the ice-cooled server 1 is set on the drink container 50. A down tube 67 is inserted in the body 56 while being pushed by a spring 58. The down tube 67 has a flange portion 59 which is in contact with the gas valve 57. The beer valve 53 is disposed in the down tube 67 while being pushed by a spring 61 so as to be in contact with the gas valve 57. A plurality of ratchets 62 for engaging the dispense head 13 or a tool for installation to the body 56 is formed at an upper periphery of the body 56 at predetermined intervals. The dispense head 13 and the body 56 are interconnected with each other by engaging the base portion 13*a* of the dispense head 13 with the ratchets 62 of the body 56. A seal ring 64 is disposed between an outer step portion 63 of the body 56 and the keg neck interface 51. Bayonet pieces 65 are formed at a lower end portion of the body 56 so as to support the spring 58 through a retaining disc 66 formed into a rectangular pulse train shape in cross-section.

The manner of operation of the ice-cooled server 1 according to the present invention will be discussed with reference to FIG. 8.

By lifting the ice-cooled server 1 through the handles 5 and 5 and by putting the ice-cooled server 1 on a protecting wall portion 49 of the drink container 50 so that the step bottom portion 9 is engaged with the protecting wall portion 49, the center axis of the dispense head 13 corresponds with the center axis of the keg neck interface 51 via the virtue of the truncated-cone shape of the step bottom portion 9. The protecting wall portion 49 is fixed on an upper portion of the drink container 50 so as to function as a protector of the keg neck interface 51 and a handle of the drink container 50. A dimensional error in the vertical direction caused during the installation of the ice-cooled server 1 to the drink container 50 is absorbed by the elastic characteristic of the supporting plate 21. Therefore, the lower end portion of the hollow shaft 32 of the dispense head 13 is engaged with the gas valve 57 through the body 56. The seal packing 46 is in contact with the inner step portion 60 of the body 56 to sealingly connect the dispense head 13 and the drink container 50.

Next, by rotating the ice-cooled server 1 a predetermined angle through the handles 5 and 5 so as to engage the base portions 13*a* of the valve housing 30 with ratchets 62 of the keg neck interface 51, the ice-cooled server 1 is interlocked with the drink container 50. Putting plural lumps of ice 70 on the cooling pipe 15 to cool the cooling pipe 15, rotating the lever 8 from the initial end to the terminal end in the guide slot 7 as shown by an arrow b in FIG. 1B, the cap 37 pushes down the hollow shaft 32 against the force of the compression spring 38, and the lower end portion of the hollow shaft 32 pushes down the gas valve 57 and the beer valve 53 against the force of the springs 58 and 61. Therefore, the seal packing 47 becomes in contact with the inner step portion 57*a* of the gas valve 57. Simultaneously, the small diameter portion 40 of the hollow shaft 32 is moved down and is communicated with the slits 48. Accordingly, the carbon dioxide gas supplied from the pressure reducing valve 4 to the gas connecting port 23 is led to a clearance between the small diameter portion 40 and the slits 48 through the valve chamber 42, then the gas is led to the body 56 through a clearance between the inner step portion 60 and the gas valve 57, and further it is led in the drink container 50 through the opening portions 68 and 69 of the body 56 as shown by arrows C in FIG. 8. As a result, the pressure in the drink container 50 is increased.

Figure 8:
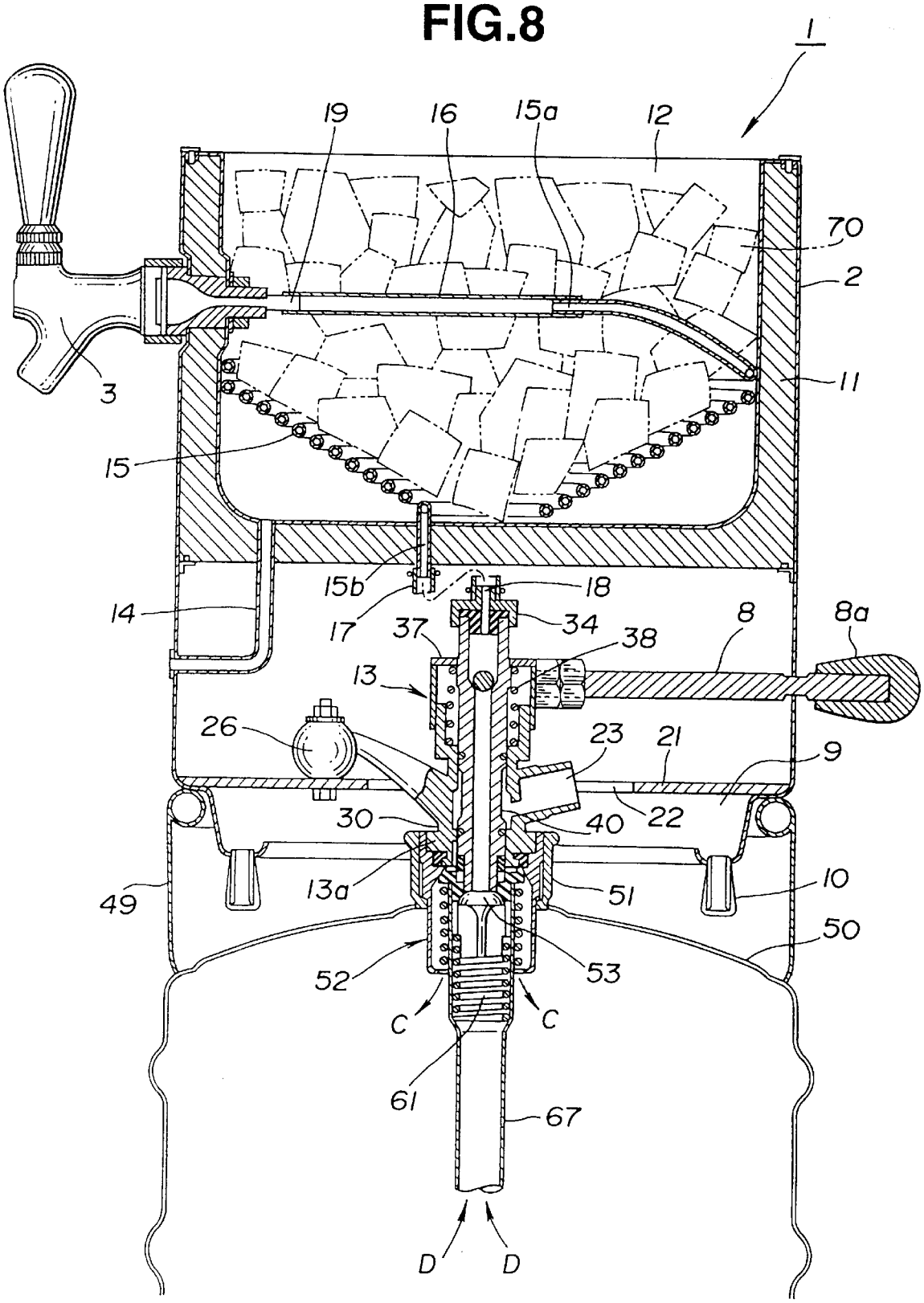
FIG. 8 is a cross sectional view that shows the first embodiment attached to the drink container.

By the increase of the inner pressure of the drink container 50, the drink such as beer in the drink container 50 is pushed out through the down tube 67, the axial hole 45 of the hollow shaft 32 and the flexible pipe 17 to the cooling pipe 15 as shown by arrows D in FIG. 8. The heat transfer of the ice 70 at the cooling pipe 15 cools the drink passing through the cooling pipe 15. The cooled drink then reaches the dispense cock 3 so that the cooled drink is poured to external by opening the dispense cock 3. When the inner pressure in the drink container 60 is increased, the check valve 44 inserted in the enlarged hole portion 43 is moved up so as to form a passage for flowing the drink outward and is not in contact with the packing 33.

In case that the ice-cooled server 1 is detached from the drink container 50, firstly the gas valve 57 and the beer valve 53 are closed by inversely rotating the lever 8 from the terminal end to the initial end. Then, the outer shell body 2 is inversely rotated with respect to the rotational direction in the installation thereof through the handles 5 and 5 so that the base portion 13*a* is released from the ratchets 62. Then, by lifting the ice-cooled server 1, it is completely detached from the drink container 50.

As mentioned above, the installation and detachment of the ice-cooled server 1 to and from the drink container 50 becomes very easy. More particularly, the ice-cooled server 1 according to the present invention facilitates the steps required in a conventional server that a set bar is rotated by one hand and the server is rotated by the other hand for installing or detaching the conventional server to or from a drink container.

Figure 9:
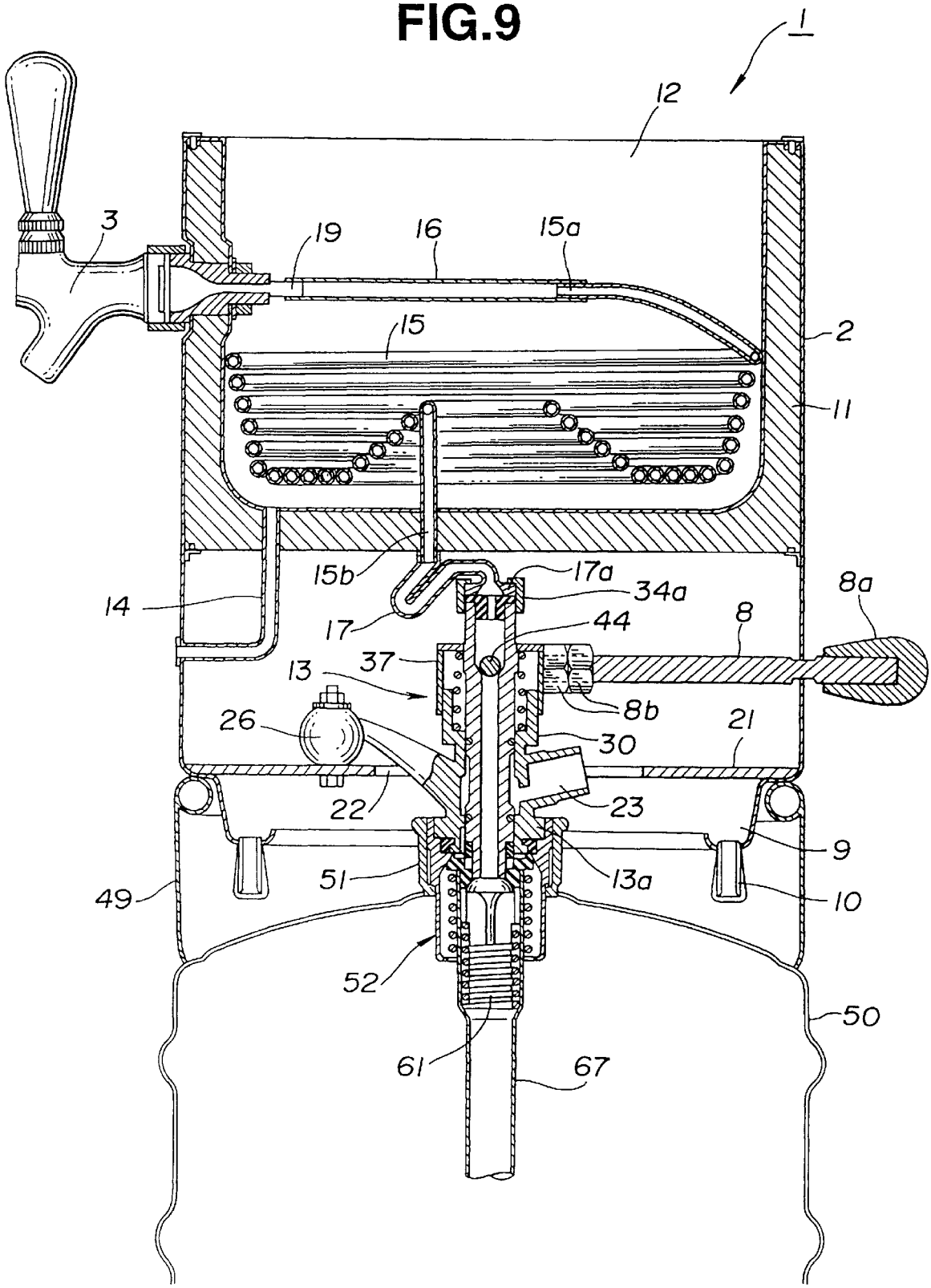
FIG. 9 is a cross sectional view that shows a second embodiment of the ice-cooled server attached to the drink container.

Referring to FIG. 9, there is shown a second embodiment of the ice-cooled server 1 according to the present invention.

The construction of the second embodiment is generally similar to that of the first embodiment except that the appearance of the spiraled cooling pipe 15 of the second embodiment is differently formed. More particularly, a center portion of the spiraled cooling pipe 15 is upwardly banked toward the center axis of the ice-cooled server 1. An intermediate portion of the spiraled cooling pipe 15 is kept flat. An outer portion of the spiraled cooling pipe 15 is raised up along the inner wall of the refrigerant receiver 12, as shown in FIG. 9. This arrangement of the spiraled cooling pipe 15 decreases a space formed between the refrigerant receiver 12 and the cooling pipe 15 and enables the length of the cooling pipe 15 to be increased by the increase of the spiraled number of the cooling pipe 15. Therefore, the cooling capacity of the cooling pipe 15 is further improved.

In addition to the rearrangement of the cooling pipe 15, the flexible pipe 17 of the second embodiment is arranged to have a connecting end portion 17*a* which is integrally formed with the flexible pipe 17 and which is fixed to the end of the hollow shaft 32 by means of a collar 34*a*. The collar 34*a* is screwed to the upper end portion of the hollow pipe 32. The other parts and elements of the second embodiment are the same as those of the first embodiment. Further, the advantages gained thereby are the same as those by the first embodiment, and therefore the same parts and elements are designated by the same reference numerals. The explanation of those parts and elements are omitted herein.

With the thus arranged first and second embodiments according to the present invention, the installation and detachment of the ice-cooled server 1 is easily and firmly executed by setting the step bottom portion 9 of the outer shell body 2 on the drink container 50 and by rotating the outer shell body 2 by a predetermined angle through the handles 5 and 5. This simplifies the structure of the ice-cooled server 1 and improves the portability thereof. Further, by installing refrigerant such ice in the refrigerant receiver 12, the cooling pipe 15 set in the refrigerant receiver 12 is efficiently in contact with the refrigerant and is cooled. Therefore, by opening the dispense cock 3, the cooled drink such as beer, which is preferably cooled while suppressing foaming, is poured into a mug or jug. Even if the drink in the drink container 50 is not sufficiently cooled, this ice-cooled server 1 according to the present invention preferably cools the drink. This arranged ice-cooled server can be used by several persons by putting it on a table in a drink store. Further, as far as possible to prepare some ice for this server, this server and drink container can be used in various situations such as in outdoors and at home.

While the invention has been particularly shown and described with reference to preferred embodiments thereof, it will be understood by those skilled in the art that the foregoing and other changes in form and details can be made therein without departing from the spirit and scope of the invention.

The entire disclosure of Japanese Patent Application No. 9-24570 filed on Feb. 7, 1997 including specification, claims, drawings and summary are incorporated herein by reference in its entirety.

What is claimed is:

1. An ice-cooled server installed on a drink container, said ice-cooled server comprising:

an outer shell body including a step bottom portion put on the drink container;

a refrigerant receiver fixedly put inside of said outer shell body;

a cooling pipe formed into a spiral, said cooling pipe being fixedly disposed in said refrigerant receiver;

a dispense cock disposed at an outer periphery of said outer shell body and connected to an end of said cooling pipe; and a dispense head fixed at a lower and inside portion of said outer shell body through a supporting plate made of elastic member, said dispense head being connected to the other end of said cooling pipe.

2. An ice-cooled server as claimed in claim 1, wherein said dispense head is disposed at a generally center portion of said outer shell body and is connected to the other end of said cooling pipe through a flexible pipe.

3. An ice-cooled server as claimed in claim 1, wherein said dispense cock is fixed on the outer periphery of said outer shell body and is connected to the one end of said cooling pipe through a connecting pipe.

4. An ice-cooled server as claimed in claim 1, further comprising a pair of handles which are fixed on said outer shell body so as to locate oppositely with respect to the center axis of said outer shell body.

5. An ice-cooled server as claimed in claim 1, wherein the supporting plate has a deformed slot formed by the combination of a slot and a circular hole, said dispense head being imbedded in the deformed slot.

6. An ice-cooled server as claimed in claim 5, wherein a lower portion of said dispense head is embedded in the deformed slot, a gas connecting port of said dispense head being fixed to the supporting plate through a bracket by means of bolts, a set bar of said dispense head being fixed to the supporting plate by means of a bolt and nut.

7. An ice-cooled server as claimed in claim 1, wherein said cooling pipe has an appearance of a cone shape.

8. An ice-cooled server as claimed in claim 1, wherein an appearance of said cooling pipe is formed such that a center portion of a spiral of said cooling pipe is upwardly banked toward the center axis of the ice-cooled server, an intermediate portion of the spiral is kept flat, and an outer portion of the spiral is raised up along an inner wall of said refrigerant receiver.

9. An ice-cooled server as claimed in claim 1, wherein the step bottom portion of said outer shell body is formed into a truncated-cone shape such that the center axis of the ice-cooled server corresponds with the center axis of the drink container when the step bottom portion is put on a protecting wall portion of the drink container.

10. An ice-cooled server installed on a drink container, said ice-cooled server comprising:

an outer shell body of a cylindrical shape including a truncated-cone shaped step bottom portion which is engaged with a protecting wall portion of the drink container;

a plurality of leg portions fixed to the step bottom portion;

a pair of handles fixed to said outer shell body so as to locate oppositely with respect to the center axis of said outer shell body;

a guide slot formed on said outer shell body so that its one end is lower than its other end;

a lever extending through said guide slot;

a pressure reducing valve fixed on said outer shell body, a small-sized carbon dioxide gas cylinder is installed to said pressure reducing valve;

a refrigerant receiver fixedly put inside of said outer shell body;

a cooling pipe formed into a spiral, said cooling pipe being fixedly disposed in said refrigerant receiver;

a dispense cock fixed to said outer shell body and connected to an end of said cooling pipe; and a dispense head fixed at a lower and inside portion of said outer shell body through a supporting plate;

a flexible pipe connecting the other end of sad cooling pipe and a connecting portion of said dispense head;

a connecting pipe connecting a gas connecting portion of said dispense head and said pressure reducing valve; and a drain pipe connected to said refrigerant receiver and fixed to said outer shell body.

* * * * *